US005460136A

United States Patent [19]

Yamazaki et al.

[11] Patent Number: 5,460,136

[45] Date of Patent: Oct. 24, 1995

[54] EVAPORATIVE FUEL-ADSORBING DEVICE AND EVAPORATIVE EMISSION CONTROL SYSTEM INCLUDING SAME

[75] Inventors: Kazumi Yamazaki; Kouichi Hidano; Teruo Wakashiro; Takeshi Hara, all of Wako; Tomoyuki Kawakami, Tochigi, all of Japan

[73] Assignee: Honda Giken Kogyo Kabushiki Kaisha, Minato, Japan

[21] Appl. No.: 329,831

[22] Filed: Oct. 27, 1994

[30] Foreign Application Priority Data

Oct. 28, 1993 [JP] Japan ..... 5-292782
Dec. 27, 1993 [JP] Japan ..... 5-348572

[51] Int. Cl.[6] ..... F02M 25/08

[52] U.S. Cl. ..... 123/519; 123/520

[58] Field of Search ..... 123/516, 518, 123/519, 520

[56] References Cited

U.S. PATENT DOCUMENTS

| | | | |
|---|---|---|---|
| 4,308,840 | 1/1982 | Hiramatsu | 123/519 |
| 4,894,072 | 1/1990 | Turner et al. | 123/519 |
| 4,919,103 | 4/1990 | Ishiquro et al. | 123/519 |
| 4,951,643 | 8/1990 | Sato et al. | 123/519 |
| 5,056,494 | 10/1991 | Kayanuma | 123/519 |
| 5,111,795 | 5/1992 | Thompson | 123/519 |
| 5,143,041 | 9/1992 | Franzke | 123/516 |
| 5,170,765 | 12/1992 | Hoshino et al. | 123/519 |

FOREIGN PATENT DOCUMENTS 1-159455 6/1989 Japan .

*Primary Examiner*—Thomas N. Moulis
*Attorney, Agent, or Firm*—Nikaido, Marmelstein, Murray & Oram

[57] ABSTRACT

An evaporative fuel-adsorbing device adsorbs evaporative fuel generated from a fuel tank of an internal combustion engine. A partition divides the interior of a casing at least into a first adsorbent chamber and a second adsorbent chamber. Adsorbents are charged in the first adsorbent chamber and the second adsorbent chamber, respectively, for adsorbing the evaporative fuel. The evaporative fuel from the fuel tank is permitted to flow into the first adsorbent chamber via a charging port provided therein. The evaporative fuel desorbed from the adsorbents in the adsorbent chambers are permitted to flow out of the first adsorbent chamber via a purging port provided therein. The second adsorbent chamber is communicated with the atmosphere via an air-inlet port. The maximum flow rate of the evaporative fuel through a communication passage connecting between the first and second adsorbent chambers is changed in dependence on at least one of an amount of the evaporative fuel flowing into the evaporative fuel-adsorbing device and an amount of the evaporative fuel flowing out of same. An evaporative emission control system incorporating the evaporative fuel-adsorbing device is also provided.

18 Claims, 6 Drawing Sheets

EVAPORATIVE FUEL-ADSORBING DEVICE AND EVAPORATIVE EMISSION CONTROL SYSTEM INCLUDING SAME

BACKGROUND OF THE INVENTION

1. Field of the Invention

This invention relates to an evaporative fuel-adsorbing device for adsorbing evaporative fuel generated from a fuel tank of an internal combustion engine, and an evaporative emission control system for preventing evaporative fuel from being emitted into the atmosphere by the use of the evaporative fuel-adsorbing device.

2. Prior Art

Conventionally, an evaporative emission control system of this kind has been proposed by Japanese Provisional Patent Publication (Kokai) No. 1-159455. In addition to an ordinary canister for adsorbing evaporative fuel generated from a fuel tank when a vehicle in which the fuel tank is installed is parking or when an engine installed in the vehicle is operating, this evaporative emission control system includes a canister for exclusive use in refueling, which is adapted to adsorb evaporative fuel generated when the fuel tank is being refueled. Further, to solve the problem of a poor adsorbing efficiency of the ordinary canister due to a high flow velocity of evaporative fuel generated when the fuel tank is refueled, in the proposed evaporative emission control system, the canister for exclusive use in refueling is provided with partitions within the canister which divide its adsorbent-accommodating space into a plurality of layers, and the direction of flow of the evaporative fuel is changed to reduce the flow velocity of the evaporative fuel, thereby enhancing the adsorbing efficiency of the canister without increasing the size (ratio L/D (length/diameter)) of the canister.

However, with the conventional evaporative emission control system, the canister for refueling is intended exclusively for refueling, and it is not used on occasions other than at refueling. Once the evaporative fuel adsorbed is purged into the engine, it becomes empty, i.e. contains no evaporative fuel, resulting in a lower utilization factor of the activated carbon. Further, two batches of activated carbon have to be provided as adsorbents, one for the canister for exclusive use in refueling, and the other for the ordinary canister, which results in use of an increased amount of activated carbon, leading to an increased cost. Further, it is required to provide a plurality of purging passages connecting between the respective canisters and the intake passages for discharging evaporative fuel adsorbed in the canisters, which complicates the construction of the system.

Further, in the conventional evaporative emission control system, in purging a large amount of evaporative fuel for enhancing the utilization factor of the adsorbent, the flow resistance of a communication passage connecting between one layer of the adsorbent and another layer divided by a partition is large since the communication passage is narrow, which prevents a sufficient amount of evaporative fuel from being purged. As a result, it takes much time to purge all the evaporative fuel adsorbed by the adsorbent, and hence if traveling of the vehicle is repeatedly carried out at short time intervals, evaporative fuel adsorbed in the canister for refueling remains unpurged, resulting in a low utilization factor of the adsorbent.

SUMMARY OF THE INVENTION

It is a first object of the invention to provide an evaporative fuel-adsorbing device which is capable of enhancing the utilization factor of the adsorbent without increasing the amount of the adsorbent used, and at the same time permitting a simplified construction involving a purging passage connected thereto.

It is a second object of the invention to provide an evaporative emission control system which is capable of enhancing the utilization factor of the adsorbent without increasing the amount of the adsorbent used, and at the same time has a simplified construction involving a purging passage connected to an evaporative fuel-adsorbing device thereof.

To attain the first object, according to a first aspect of the invention, there is provided an evaporative fuel-adsorbing device for adsorbing an evaporative fuel generated from a fuel tank of an internal combustion engine, comprising:

a casing;

partition means arranged within the casing, the partition means dividing an interior of the casing at least into a first adsorbent chamber and a second adsorbent chamber;

absorbents charged, respectively, in the first adsorbent chamber and the second adsorbent chamber for adsorbing the evaporative fuel;

charging port means provided in the first adsorbent chamber for permitting the evaporative fuel from the fuel tank to flow into the first adsorbent chamber;

purging port means provided in the first adsorbent chamber for permitting the evaporative fuel desorbed from the absorbents in the first and second adsorbent chambers to flow out of the first adsorbent chamber;

air-inlet port means provided in the second adsorbent chamber and communicating the second adsorbent chamber with the atmosphere;

communication passage means connecting between the first adsorbent chamber and the second adsorbent chamber;

flow rate-changing means for changing a maximum flow rate of the evaporative fuel through the communication passage means, in dependence on at least one of an amount of the evaporative fuel flowing into the evaporative fuel-adsorbing device and an amount of the evaporative fuel flowing out of the evaporative fuel-adsorbing device.

Preferably, the charging port means is connected to the fuel tank, and the communication passage means comprises a first passage which is constantly open, and a second passage, the flow rate-changing means opening the second communication passage at least when the fuel tank is refueled.

More preferably, the flow rate-changing means comprises valve means arranged in the second passage, the valve means opening at least when the fuel tank is refueled.

Also preferably, the flow rate-changing means comprises valve means arranged in the second passage, the valve means opening when the fuel tank is refueled and when the evaporative fuel is purged from the evaporative fuel-adsorbing device.

Further preferably, the valve means arranged in the second passage comprises a one-way valve which opens when pressure within the first adsorbent chamber is higher than pressure within the second adsorbent chamber by a predetermined amount or more.

Still more preferably, the valve means arranged in the second passage comprises a first one-way valve which opens when pressure within the first adsorbent chamber is higher than pressure within the second adsorbent chamber by a predetermined amount or more, and a second one-way valve which opens when the pressure within the second adsorbent chamber is higher than the pressure within the first adsorbent chamber by a predetermined amount or more.

Also preferably, the valve means arranged in the second passage comprises an electromagnetic valve.

Preferably, the charging port means comprises a first port for use in refueling the fuel tank, and a second port for use on occasions other than refueling the fuel tank, the first port being connected via a first charging passage to the fuel tank, the second port being connected via a second charging passage to the fuel tank.

More preferably, the evaporative fuel-adsorbing device include a control valve arranged in the first charging passage, and valve control means for opening the control valve when the fuel tank is refueled.

To attain the second object, according to a second aspect of the invention, there is provided an evaporative emission control system for an internal combustion engine having a fuel tank and an intake passage, including an evaporative fuel-adsorbing device for adsorbing evaporative fuel generated from the fuel tank, a charging passage connecting between the evaporative fuel-adsorbing device and the fuel tank for introducing the evaporative fuel generated from the fuel tank into the evaporative fuel-adsorbing device, a purging passage connecting between the evaporative fuel-adsorbing device and the intake passage for purging the evaporative fuel adsorbed by the evaporative fuel-adsorbing device into the intake passage, and an air-inlet passage connected to the evaporative fuel-adsorbing device and communicating with the atmosphere.

The evaporative emission control system according to the second aspect of the invention is characterized in that the evaporative fuel-adsorbing device comprises:

- a first adsorbent chamber to which the charging passage and the purging passage are connected;
- a second adsorbent chamber to which the air-inlet passage is connected;
- absorbents charged, respectively, in the first adsorbent chamber and the second adsorbent chamber for adsorbing the evaporative fuel;
- communication passage means connecting between the first adsorbent chamber and the second adsorbent chamber;
- flow rate-changing means for changing a maximum flow rate of the evaporative fuel through the communication passage means, in dependence on at least one of an amount of the evaporative fuel flowing into the evaporative fuel-adsorbing device and an amount of the evaporative fuel flowing out of the evaporative fuel-adsorbing device.

Preferably, the charging passage comprises a first charging passage for introducing evaporative fuel generated when the fuel tank is refueled into the first adsorbent chamber, and a second charging passage for introducing evaporative fuel generated on occasions other than when the fuel tank is refueled.

More preferably, the evaporative emission control system includes a control valve arranged in the first charging passage, and valve control means for opening the control valve when the fuel tank is refueled.

Also preferably, the charging port means is connected to the fuel tank, and the communication passage means comprises a first passage which is constantly open, and a second passage, the flow ratechanging means opening the second communication passage at least when the fuel tank is refueled.

Further preferably, the flow rate-changing means comprises valve means arranged in the second passage, the valve means opening at least when the fuel tank is refueled.

Also preferably, the flow rate-changing means comprises valve means arranged in the second passage, the valve means opening when the fuel tank is refueled and when the evaporative fuel is purged from the evaporative fuel-adsorbing device.

Still more preferably, the valve means arranged in the second passage comprises a one-way valve which opens when pressure within the first adsorbent chamber is higher than pressure within the second adsorbent chamber by a predetermined amount or more.

Even more preferably, the valve means arranged in the second passage comprises a first one-way valve which opens when pressure within the first adsorbent chamber is higher than pressure within the second adsorbent chamber by a predetermined amount or more, and a second one-way valve which opens when the pressure within the second adsorbent chamber is higher than the pressure within the first adsorbent chamber by a predetermined amount or more.

Also preferably, the valve arranged in the second passage comprises an electromagnetic valve.

The above objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
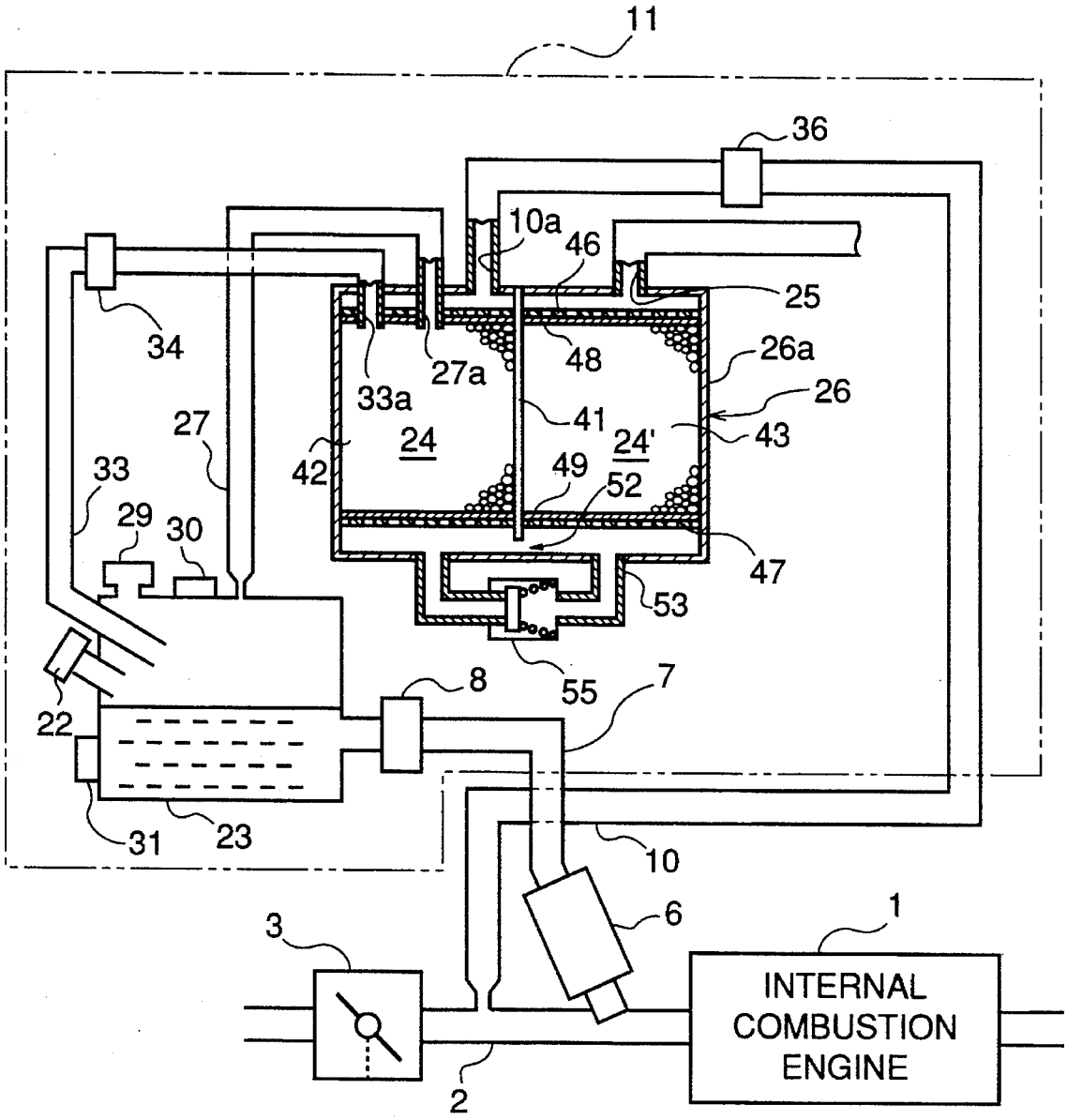
FIG. 1 is a block diagram showing the whole arrangement of an evaporative emission control system for an internal combustion engine, according to a first embodiment of the invention.

Referring first to FIG. 1, there is shown the whole arrangement of an evaporative emission control system for an internal combustion engine according to an embodiment of the invention.

The evaporative emission control system 11 for controlling the emission of evaporative fuel into the atmosphere is comprised of a fuel tank 23 of an internal combustion engine 1 equipped with a filler cap 22 which is opened or removed when the fuel tank 23 is refueled, a canister 26, as an evaporative fuel-adsorbing device, accommodating adsorbents 24, 24' formed of activated carbon, a first charging passage 27 for ordinary use, connecting between the canister 26 and the top of the fuel tank 23, a second charging passage 33 for use in refueling, connecting between a portion of the fuel tank 23 in the vicinity of the filler cap 22 and the canister 26, an electromagnetic valve 34 for use in refueling arranged across the second charging passage 33 for selectively opening and closing the same, a purging passage 10 connecting between the canister 26 and an intake pipe 2 of the engine 1 at a location downstream of a throttle valve 3 arranged in the intake pipe 2, and a purge control valve 36 formed by an electromagnetic valve and arranged across the purging passage 10. The electromagnetic valve 34 and the purge control valve 36 are connected to an electronic control unit (ECU), not shown, to be controlled by driving signals therefrom.

The canister 26 is divided by a partition 41 into a first activated carbon chamber 42 and a second activated carbon chamber 43. The first and second activated carbon chambers 42, 43 are defined by a canister casing 26*a*, upper and lower retainer plates 46, 47, and the partition 41. The upper and lower retainer plates 46, 47 are formed of a porous material, and has inner side surfaces thereof lined with filters 48, 49, respectively. The first and second activated carbon chambers 42, 43 are densely charged with activated carbon adsorbents 24, 24' of almost the same kind in almost the same amount. The top of the first activated carbon chamber 42 is formed with an inlet port 27*a* for ordinary use, which is connected to the first charging passage 27, an inlet port 33*a* for use in refueling, which is connected to the second charging passage 33, and an outlet (discharge) port 10*a* which is connected to the purging passage 10. The inlet ports 27*a* and 33*a* extend through the upper retainer plate 46 and the filter 48 to directly open into the activated carbon adsorbent 24, while the output let port 10*a* opens into a gap between the casing 26*a* and the upper retainer plate 46. Further, the second activated carbon chamber 43 has an air-inlet port 25*a* formed through the top thereof. The air-inlet port 25*a* has one end thereof opening into a gap between the casing 26*a* and the upper retainer plate 46, and the other end connected to an air-inlet passage 25 communicating with the atmosphere. Further, below the partition 41, a communication passage 52 is formed in the canister 26, which is defined between the casing 26*a* and the lower retainer plate 47, through which the first activated carbon chamber 42 and the second activated carbon chamber 43 are communicated with each other. Further, a bypass passage 53 is formed in parallel with the communication passage 52 and connecting between the first activated carbon chamber 42 and the second activated carbon chamber 43 via the communication passage 53 to bypass the communication passage 52. The bypass passage 53 has a one-way valve 55 arranged therein. The one-way valve 55 opens only when pressure within the first activated carbon chamber 42 is higher than that within the second activated carbon chamber 40 by a predetermined amount or more to thereby establish another communication path (bypass) between the first activated carbon chamber 42 and the second activated carbon chamber 43.

Arranged in the intake pipe 2 at locations downstream of an end of the purging passage 10 opening into the intake pipe 2 are fuel injection valves 6 which are connected to the fuel tank 23 via a fuel supply pipe 7 and a fuel pump 8 arranged in the fuel supply pipe 7. The fuel tank 23 has a tank internal pressure sensor 29 and a fuel amount sensor 30 mounted in the top thereof for detecting pressure within the fuel tank 23 and for detecting an amount of fuel within the fuel tank 23, respectively. The fuel tank 23 also has a fuel temperature sensor 31 inserted through a side wall thereof for detecting the temperature of fuel within the fuel tank 23.

Next, description will be made as to how the evaporative emission control system constructed as above adsorbs evaporative fuel in the canister 26, and how it purges adsorbed fuel from the canister 26. First, when the vehicle is parking with the engine in stoppage or when the engine is in operation, evaporative fuel generated from the fuel tank 23 is guided via the first charging passage 27 and the inlet port 27*a* into the first activated carbon chamber 42 of the canister 26. Most of the evaporative fuel is adsorbed by the activated carbon adsorbent 24 charged in the first activated carbon chamber 42, and a slight amount thereof is further guided via the communication passage 52 below the partition 41 into the second activated carbon chamber 43. The slight amount of evaporative fuel is adsorbed by the activated carbon adsorbent 24' within the second activated carbon chamber 43. At this time, the electromagnetic valve 34 is not supplied with a driving signal from the ECU, not shown, and hence in a closed state, so that no evaporative fuel is guided via the charging passage 33 into the canister 26.

Figure 2:
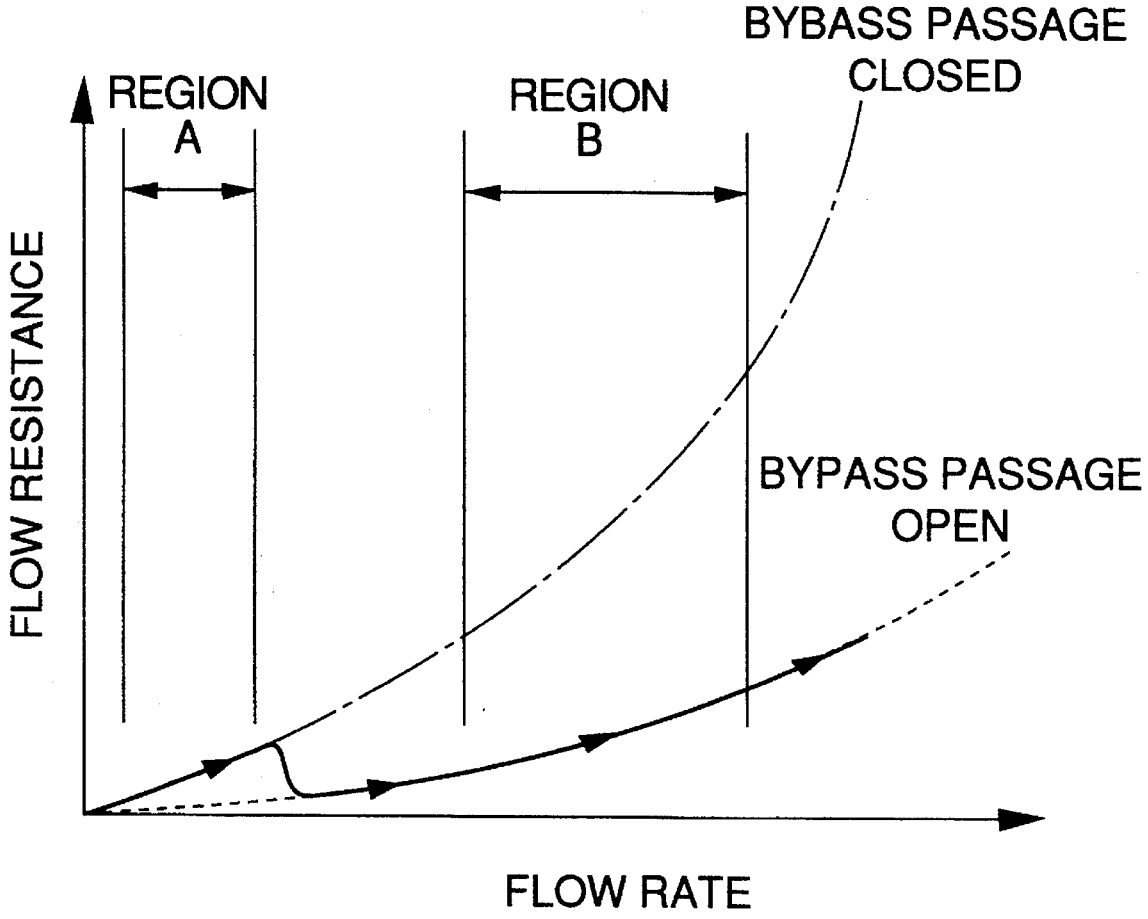
FIG. 2 is a graph showing the relationship between a flow rate of evaporative fuel introduced-from a first activated carbon chamber to a second activated carbon chamber and the flow resistance of communication passages between the two chambers.

Next, description will be made as to evaporative fuel generated from the fuel tank 23 is guided when the fuel tank is refueled. In refueling, the electromagnetic valve 34 is opened by a driving signal from the ECU. At this time, evaporative fuel is vigorously generated, and guided into the first activated carbon chamber 42 of the canister 26 via the second charging passage 33 for use in refueling which extends into the fuel tank 23 at a location in the vicinity of the filler cap 22 and the inlet port 33*a* for use in refueling which extends into the canister 26. The evaporative fuel introduced into the first activated carbon chamber 42 flows therethrough while being adsorbed by the activated carbon adsorbent 24. At this time, the interior of the first activated carbon chamber 42 is pressurized by the evaporative fuel flowing therein to a level high enough to forcibly open the one-way valve 55 in the bypass passage 53 to thereby establish additional communication between the first activated carbon chamber 42 and the second activated carbon chamber 43 through the bypass passage 53. FIG. 2 shows the relationship between the flow rate of evaporative fuel guided from the first activated carbon chamber 42 to the second activated carbon chamber 43 and the flow resistance of the communication passages 52, 53 between the two chambers. In the figure, Region A designates a range of flow rate of evaporative fuel which can be assumed when the vehicle is parking, while Region B a range of same which can be assumed when the vehicle is refueled. When the one-way valve 55 is opened, the flow resistance of the communication passages 52, 53 between the first activated carbon chamber 42 and the second activated carbon chamber 43 markedly decreases (the maximum flow rate of evaporative fuel via the communication passage 52 and the bypass passage 53 increases), so that an overflow of evaporative fuel from the first activated carbon chamber 42 rushes into the second activated carbon chamber 43 to be fully adsorbed by the activated carbon adsorbent 24 in the second activated carbon chamber 43.

Since the inlet port 27*a* for ordinary use and the inlet port 33*a* for use in refueling extend through the upper retainer plate 46 into the first activated carbon chamber 42 charged with the activated carbon adsorbent 24, evaporative fuel guided into the first activated carbon chamber 42 via the fuel port 33*a* cannot reversely flow into the inlet port 27*a*.

Next, how the adsorbed fuel is purged from the canister 26 will be described. In purging the adsorbed fuel, the ECU supplies a driving signal to the purge control valve 36 arranged across the purging passage 10 to open the same. Purging of the adsorbed fuel is carried out when the engine 1 is in a predetermined operating condition, in which negative pressure or vacuum is developed within the intake pipe 2. Vacuum in the intake pipe 2 is introduced into the first activated carbon chamber 42 via the purging passage 10 and the purge control valve 36 which is open, and further via the communication passage 52 into the second activated carbon chamber 43. Consequently, fresh air flows into the second activated carbon chamber 43 via the air-inlet passage 25 and the air-inlet port 25*a*. The flowing-in air causes the adsorbed fuel to be desorbed from the activated carbon adsorbent 24', and a mixture of the desorbed fuel and air flows from the second activated carbon chamber 43 into the second activated carbon chamber 42 via the communication passage 52. The adsorbed fuel is caused to be desorbed from the activated carbon adsorbent 24 in the first activated carbon chamber 42 as well, and the desorbed fuel is guided via the purging passage 10 into the intake pipe 2 to be drawn into combustion chambers of the engine 1.

Thus, the evaporative fuel generated ordinarily and in refueling, is adsorbed by the activated carbon adsorbents 24 and 24' in the first activated carbon chamber 42 and the second activated carbon chamber 43, which enhances the utilization factor of the activated carbon. Therefore, the amount of activated carbon can be curtailed as compared with the conventional arrangement in which separate canisters accommodating activated carbon adsorbents are provided, respectively, for use in refueling and for ordinary use. Further, since the single purging passage 10 is provided, which dispenses with provision of a plurality of purging passages, simplifying the construction of the evaporative emission control system.

Although in the above described embodiment, the first activated carbon chamber 42 and the second activated carbon chamber 43 accommodate substantially the same kind of activated carbon as the adsorbents 24, 24' in substantially the same amount, this is not limitative, but it goes without saying that different kinds of activated carbons may be used. For example, the first activated carbon chamber may be designed larger in size or volume than the second activated carbon chamber so that the latter accommodates a larger amount of activated carbon than the latter. Further, activated carbons having different properties may be used depending on components of evaporative fuel to be adsorbed thereby. For example, the first activated carbon chamber 42 may contain an activated carbon suitable for adsorbing components of evaporative fuel having relatively high boiling points, while the second activated carbon chamber 43 may contain an activated carbon suitable for adsorbing ones having relatively low boiling points. Further, although in the above described embodiment, the one-way valve 55 opens to decrease the flow resistance of the communication passageway between the first activated carbon 42 and the second activated carbon 43 when the vehicle is refueled, this is not limitative, but an electromagnetic valve may be employed instead of the one-way valve so that the opening and closing of the bypass passage is controlled by a control signal from the ECU.

Figure 3:
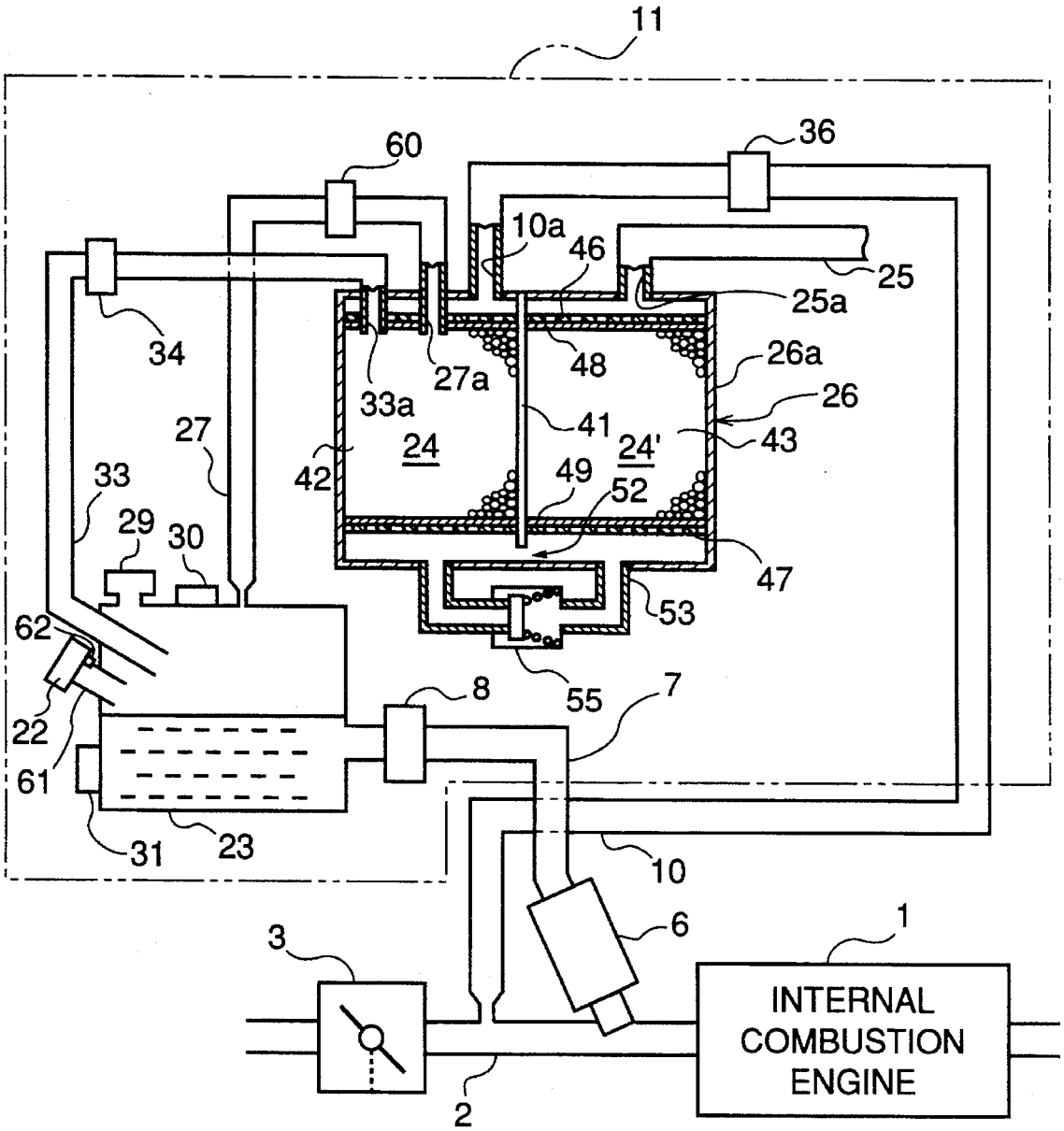
FIG. 3 is a block diagram showing the whole arrangement of an evaporative emission control system for an internal combustion engine, according to a second embodiment of the invention.

Next, a second embodiment of the invention will be described with reference to FIG. 3. In this embodiment, and a third embodiment, described hereinafter, component parts and elements appearing in FIG. 3, and FIG. 4 to FIG. 6, which correspond to ones of the first embodiment appearing in FIG. 1 are designated by identical reference numerals, and detailed description thereof is omitted.

The second embodiment is distinguished from the first embodiment in that a two-way valve 60 is arranged across the first charging passage 27 for ordinary use and refueling-detecting means 62 is provided in the vicinity of an upper end of a fuel tube 61, for detecting insertion of a filler gun or removal of a filler cap 22, and a signal indicative of detection by the refueling-detecting means 62 is supplied to the ECU.

When the pressure within the fuel tank 23 becomes higher than atmospheric pressure by a predetermined amount (e.g. 2.7 kilopascal) or more when the vehicle is parking with the engine in stoppage or when the engine is in operation, the two-way valve 60 opens to allow evaporative fuel generated from the fuel tank 23 to be guided via the first charging passage 27 and the inlet port 27*a* into the first activated carbon chamber 42 of the canister 26.

The two-way valve 60 also opens when the pressure within the fuel tank 23 becomes lower than the pressure within the first activated carbon chamber 42 by a predetermined amount or more, whereby evaporative fuel in the canister 26 is returned to the fuel tank 23.

Figure 4:
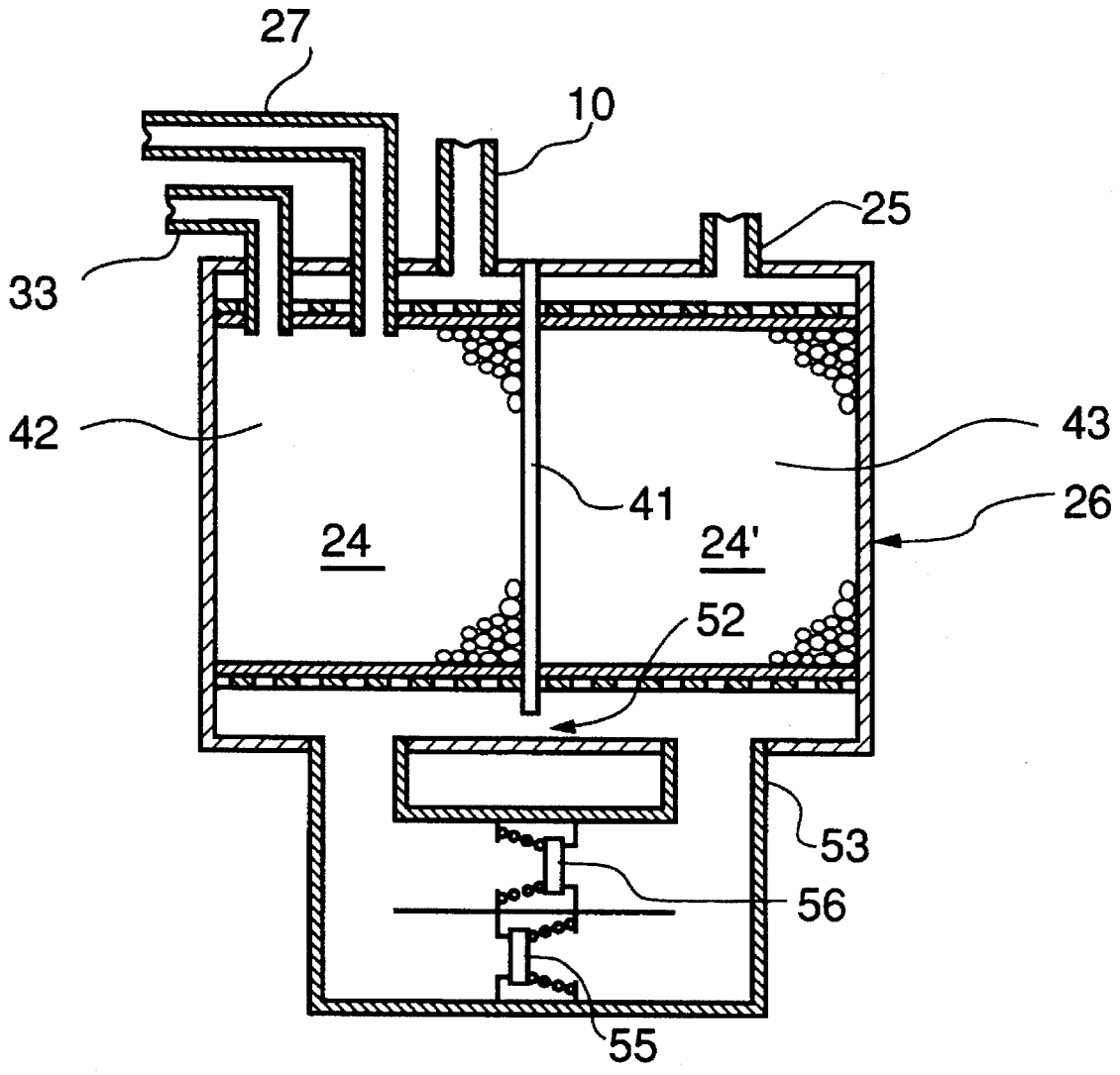
FIG. 4 is a sectional view showing an evaporative fuel-adsorbing device as part of an evaporative emission control system according to a third embodiment of the invention.

Next, the third embodiment of the invention will be described with reference to FIG. 4. Elements and parts of the arrangement of the evaporative emission control system omitted from FIG. 4 is identical to those of the arrangement shown in FIG. 1.

In the present embodiment, in addition to the one-way valve (charging valve) 55, a one-way valve (purging valve) 56 is arranged in the bypass passage 53 in parallel with the one way valve 55. The one-way valve 56 opens when the pressure within the second activated carbon chamber 43 becomes higher than the pressure within the first activated carbon chamber 42 by a predetermined amount or more.

According to this construction of the canister 26, the one-way valve 55 opens only when the fuel tank 23 is refueled, while the one-way valve 56 opens at the time of purging when the pressure within the second activated carbon chamber 43 becomes higher than the pressure within the first activated carbon chamber 42. This opening operation of the one-way valve 56 markedly decreases the flow resistance of the communication passageway between the first activated carbon chamber 42 and the second activated carbon chamber 43 (the maximum flow rate of gases through the total communication passage (the communication passage 52+ the bypass passage) increases) in purging as well, so that desorption of evaporative fuel from the activated carbon adsorbents 24, 24' is smoothly effected. As a result, it is possible to purge the adsorbed fuel within a short time period to enhance the utilization factor of the adsorbents (activated carbon) within the canister.

Figure 5:
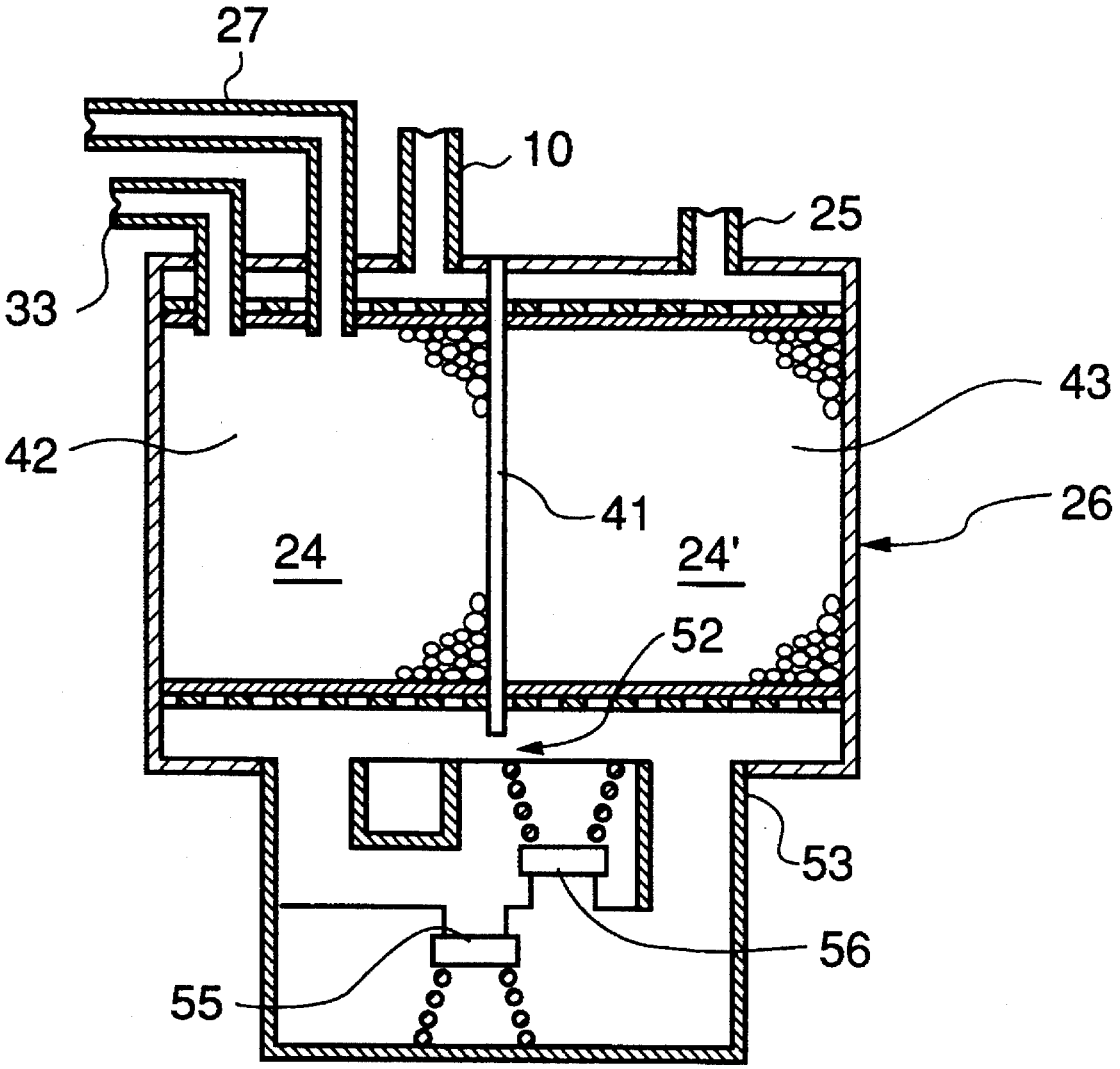
FIG. 5 shows a variation of the evaporative fuel-adsorbing device of the third embodiment shown in FIG. 4.

FIG. 5 shows a variation of the arrangement of the two one-way valves 55 and 56. In this variation, the two valves 55, 56 are disposed such that they open when their respective valve elements move in opposite directions to each other.

Figure 6:
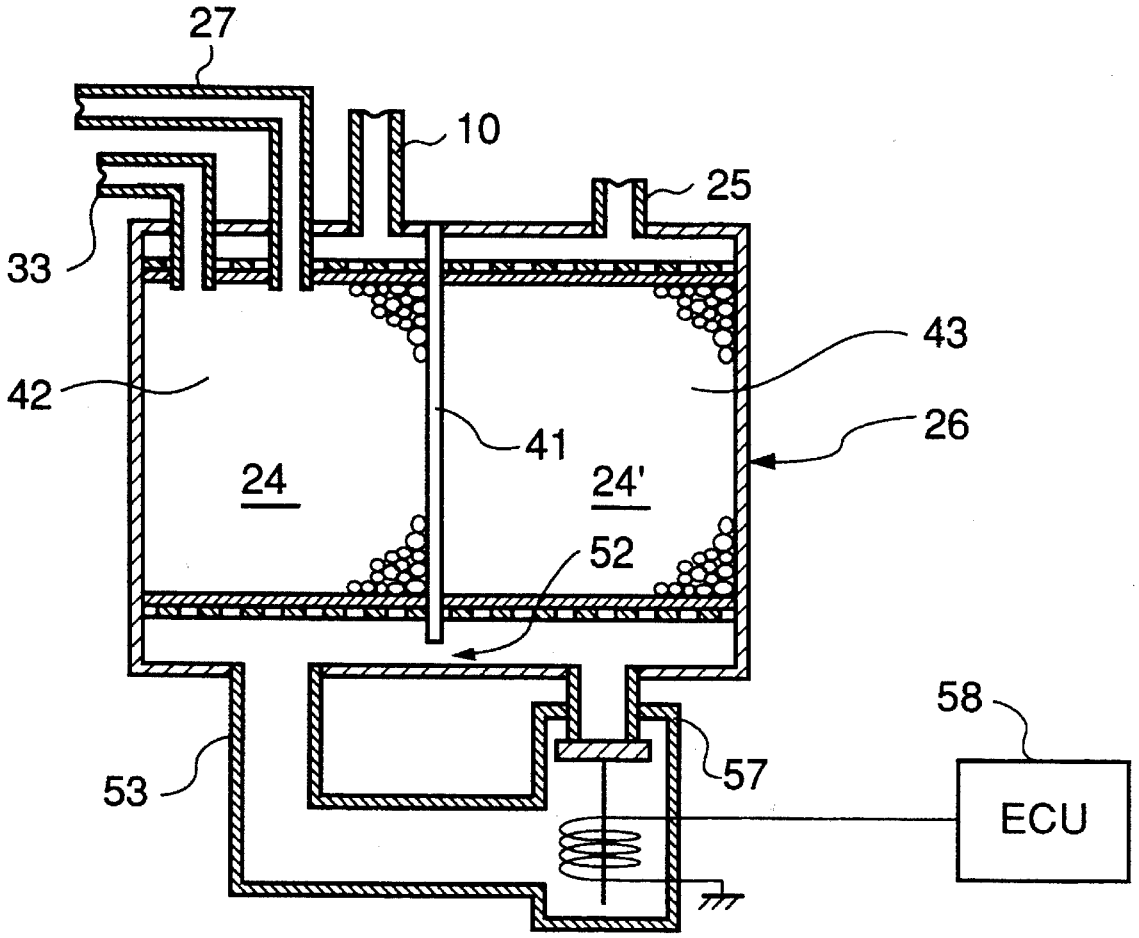
FIG. 6 shows another variation of the evaporative fuel-adsorbing device of the third embodiment shown in FIG. 4.

Further, as shown in FIG. 6, a further variation may be adopted in which the two one-way valves 55 and 56 are replaced by an electromagnetic valve 57 which is controlled by the ECU 58 to open only in refueling or in both refueling and purging. The detection of refueling is effected by the refueling-detecting means 62, e.g. through detection of removal of the filler cap 22.

Further, in the above described embodiments, the electromagnetic valve 34 is implemented by an electromagnetic control valve which is controlled by the ECU, this is not limitative, but a mechanical valve, for instance, may be used, instead, which opens in response to insertion of the filler gun or removal of the filler cap.

What is claimed is:

1. An evaporative fuel-adsorbing device for adsorbing an evaporative fuel generated from a fuel tank of an internal combustion engine, comprising:

a casing;

partition means arranged within said casing, said partition means dividing an interior of said casing at least into a first adsorbent chamber and a second adsorbent chamber;

absorbents charged, respectively, in said first adsorbent chamber and said second adsorbent chamber for adsorbing said evaporative fuel;

charging port means provided in said first adsorbent chamber for permitting said evaporative fuel from said fuel tank to flow into said first adsorbent chamber;

purging port means provided in said first adsorbent chamber for permitting said evaporative fuel desorbed from said absorbents in said first and second adsorbent chambers to flow out of said first adsorbent chamber;

air-inlet port means provided in said second adsorbent chamber and communicating said second adsorbent chamber with the atmosphere;

communication passage means connecting between said first adsorbent chamber and said second adsorbent chamber;

flow rate-changing means for changing a maximum flow rate of said evaporative fuel through said communication passage means, in dependence on at least one of an amount of said evaporative fuel flowing into said evaporative fuel-adsorbing device and an amount of said evaporative fuel flowing out of said evaporative fuel-adsorbing device.

2. An evaporative fuel-adsorbing device according to claim 1, wherein said charging port means is connected to said fuel tank, and said communication passage means comprises a first passage which is constantly open, and a second passage, said flow rate-changing means opening said second communication passage at least when said fuel tank is refueled.

3. An evaporative fuel-adsorbing device according to claim 2, wherein said flow rate-changing means comprises valve means arranged in said second passage, said valve means opening at least when said fuel tank is refueled.

4. An evaporative fuel-adsorbing device according to claim 2, wherein said flow rate-changing means comprises valve means arranged in said second passage, said valve means opening when said fuel tank is refueled and when said evaporative fuel is purged from said evaporative fuel-adsorbing device.

5. An evaporative fuel-adsorbing device according to claim 3, wherein said valve means arranged in said second passage comprises a one-way valve which opens when pressure within said first adsorbent chamber is higher than pressure within said second adsorbent chamber by a predetermined amount or more.

6. An evaporative fuel-adsorbing device according to claim 4, wherein said valve means arranged in said second passage comprises a first one-way valve which opens when pressure within said first adsorbent chamber is higher than pressure within said second adsorbent chamber by a predetermined amount or more, and a second one-way valve which opens when said pressure within said second adsorbent chamber is higher than said pressure within said first adsorbent chamber by a predetermined amount or more.

7. An evaporative fuel-adsorbing device according to claim 4, wherein said valve means arranged in said second passage comprises an electromagnetic valve.

8. An evaporative fuel-adsorbing device according to claim 2, wherein said charging port means comprises a first port for use in refueling said fuel tank, and a second port for use on occasions other than refueling said fuel tank, said first port being connected via a first charging passage to said fuel tank, said second port being connected via a second charging passage to said fuel tank.

9. An evaporative fuel-adsorbing device according to claim 8, including a control valve arranged in said first charging passage, and valve control means for opening said control valve when said fuel tank is refueled.

10. In an evaporative emission control system for an internal combustion engine having a fuel tank and an intake passage, including an evaporative fuel-adsorbing device for adsorbing evaporative fuel generated from said fuel tank, a charging passage connecting between said evaporative fuel-adsorbing device and said fuel tank for introducing said evaporative fuel generated from said fuel tank into said evaporative fuel-adsorbing device, a purging passage connecting between said evaporative fuel-adsorbing device and said intake passage for purging said evaporative fuel adsorbed by said evaporative fuel-adsorbing device into said intake passage, and an air-inlet passage connected to said evaporative fuel-adsorbing device and communicating with the atmosphere, the improvement wherein said evaporative fuel-adsorbing device comprises:

a first adsorbent chamber to which said charging passage and said purging passage are connected;

a second adsorbent chamber to which said air-inlet passage is connected;

absorbents charged, respectively, in said first adsorbent chamber and said second adsorbent chamber for adsorbing said evaporative fuel;

communication passage means connecting between said first adsorbent chamber and said second adsorbent chamber;

flow rate-changing means for changing a maximum flow rate of said evaporative fuel through said communication passage means, in dependence on at least one of an amount of said evaporative fuel flowing into said evaporative fuel-adsorbing device and an amount of said evaporative fuel flowing out of said evaporative fuel-adsorbing device.

11. An evaporative emission control system according to claim 10, wherein said charging passage comprises a first charging passage for introducing evaporative fuel generated when said fuel tank is refueled into said first adsorbent chamber, and a second charging passage for introducing evaporative fuel generated on occasions other than when said fuel tank is refueled.

12. An evaporative emission control system according to claim 11, including a control valve arranged in said first charging passage, and valve control means for opening said control valve when said fuel tank is refueled.

13. An evaporative emission control system according to claim 10, wherein said charging port means is connected to said fuel tank, and said communication passage means comprises a first passage which is constantly open, and a second passage, said flow rate-changing means opening said second communication passage at least when said fuel tank is refueled.

14. An evaporative emission control system according to claim 13, wherein said flow rate-changing means comprises valve means arranged in said second passage, said valve means opening at least when said fuel tank is refueled.

15. An evaporative emission control system according to claim 13, wherein said flow rate-changing means comprises valve means arranged in said second passage, said valve means opening when said fuel tank is refueled and when said evaporative fuel is purged from said evaporative fuel-adsorbing device.

16. An evaporative emission control system according to claim 14, wherein said valve means arranged in said second passage comprises a one-way valve which opens when pressure within said first adsorbent chamber is higher than pressure within said second adsorbent chamber by a predetermined amount or more.

17. An evaporative emission control system according to claim 15, wherein said valve means arranged in said second passage comprises a first one-way valve which opens when pressure within said first adsorbent chamber is higher than pressure within said second adsorbent chamber by a predetermined amount or more, and a second one-way valve which opens when said pressure within said second adsorbent chamber is higher than said pressure within said first adsorbent chamber by a predetermined amount or more.

18. An evaporative emission control system according to claim 15, wherein said valve arranged in said second passage comprises an electromagnetic valve.

* * * * *